US006913009B2

(12) United States Patent
Shuto

(10) Patent No.: US 6,913,009 B2
(45) Date of Patent: Jul. 5, 2005

(54) DIAMOND CUTTING METHOD, ENNEAHEDRAL-CUT DIAMONDS AND ASSEMBLY OF ENNEAHEDRAL-CUT DIAMONDS

(76) Inventor: Naotake Shuto, 7-27, Kohyodai 4-chome, Izumi-ku, Sendai-shi, 981-3102 (JP)

( * ) Notice: Subject to any disclaimer, the term of this patent is extended or adjusted under 35 U.S.C. 154(b) by 490 days.

(21) Appl. No.: 10/042,204

(22) Filed: Jan. 11, 2002

(65) Prior Publication Data

US 2002/0096167 A1 Jul. 25, 2002

(30) Foreign Application Priority Data

Jan. 22, 2001 (JP) ..... 2001-013140

(51) Int. Cl.[7] ..... B28D 5/00; A44C 17/00
(52) U.S. Cl. ..... 125/30.01; 63/32
(58) Field of Search ..... 125/30.01; 63/32

(56) References Cited

U.S. PATENT DOCUMENTS 4,308,727 A * 1/1982 Elbe ..... 63/32
4,555,916 A * 12/1985 Grossbard ..... 63/32
5,190,024 A * 3/1993 Senanayake ..... 125/30.01
5,657,646 A * 8/1997 Rosenberg ..... 63/32
5,657,647 A * 8/1997 Freiesleben ..... 63/32
6,397,832 B1 * 6/2002 Shuto ..... 125/30.01
6,405,562 B1 * 6/2002 Zimet et al. ..... 63/32
6,449,985 B1 * 9/2002 Kejejian ..... 63/32
6,604,382 B2 * 8/2003 Shuto ..... 63/32
6,615,611 B1 * 9/2003 Schachter et al. ..... 63/32

* cited by examiner

*Primary Examiner*—Eileen P. Morgan
(74) *Attorney, Agent, or Firm*—Rader, Fishman & Grauer PLLC

(57) ABSTRACT

Disclosed is a diamond cutting method comprising the steps of: forming a square or rectangular table in a piece of gemstone; and forming a pavilion continuous to the table by cutting vertically from each side of the square or rectangular table to define the four lower-girdle facets and by cutting obliquely from each corner of the square or rectangular table to the culet of the pavilion to form four lower-main facets, whereby the upper opposite sides of each lower-main facet adjoining the adjacent lower-girdle facets whereas the lower opposite sides of each lower-main facet adjoining the confronting lower opposite sides of the adjacent lower-main facets. An enneahedral-cut diamond thus produced is a table-and-pavilion structure, permitting plural diamonds to be arranged side by side as a whole with their square or rectangular tables directed inward or outward.

3 Claims, 5 Drawing Sheets

DIAMOND CUTTING METHOD, ENNEAHEDRAL-CUT DIAMONDS AND ASSEMBLY OF ENNEAHEDRAL-CUT DIAMONDS

BACKGROUND OF THE INVENTION

1. Field of the Invention

The present invention relates to a diamond cutting method, enneahedral-cut diamonds and an assembly of enneahedral diamonds. The enneahedral-cut diamond has a square or rectangular table with eight facets defining together a pavilion.

2. Related Arts

A diamond of the finest cut with 58 facets is well known as a brilliant cut. Japanese Patent H9-1105A shows a brilliant cut whose unique girdle shape is claimed for patent.

The brilliant cut needs to have a regular octagonal table, which regular octagon is defined by: drawing a straight reference line passing through the center of a given circle; drawing another reference line passing through the center of the circle to be 90 degrees apart from the first reference line; drawing a 45 degree-inclined line in each quadrant of the circle; drawing a circle to define the table; and drawing chords to connect two intersecting points on the circle. Bezel facets and upper-girdle facets (33 facets in total) are formed between the table and the girdle of the gemstone.

The pavilion underneath the girdle has lower-girdle facets and lower-main facets (25 facets in total) formed in the areas divided by the keel lines starting from each corner of the regular octagonal table and converging to the culet of the pavilion.

The brilliant cut has the following proportion: the diameter of the girdle is 100%; the height is 60.4%; the diameter of the table is 55%; the thickness of the crown is 15.4%; the depth of the pavilion is 43%; the inclination angle of the crown is 34 degrees and the inclination angle of the pavilion is 41 degrees (A.G.S. Proportion Standard).

The brilliant cut causes an incident light rays to be diffused inside, not producing a single clear reflected light at an established angle of view. The cutting is a very elaborate and time-consuming work because of the large number of facets and the complicated arrangement of the facets, which is one major cause for the expensiveness of brilliant cuts.

Such brilliant cuts can be set on an object, but cannot be structurally combined as a whole.

SUMMARY OF THE INVENTION

One object of the present invention is to provide a diamond cutting method according to which a gemstone can be cut easily to produce a unique reflected light pattern.

Another object of the present invention is to provide an enneahedral-cut diamond which can be combined with other enneahedral-cut diamonds as a whole to provide diamonds of different shapes. An enneahedral-cut diamond according to the present invention has a square or rectangular table with eight facets defining together a pavilion.

To attain these objects, a diamond cutting method comprising the steps of: forming a square or rectangular table in a piece of gemstone; and forming a pavilion continuous to the table by cutting vertically from each side of the square or rectangular table to define the four lower-girdle facets and by cutting obliquely from each corner of the square or rectangular table to the culet of the pavilion to form four lower-main facets, whereby the upper opposite sides of each lower-main facet adjoining the adjacent lower-girdle facets whereas the lower opposite sides of each lower-main facet adjoining the confronting lower opposite sides of the adjacent lower-main facets.

Each lower-girdle facet is isosceles triangular, and each lower-main facet is rhomboid.

An enneahedral-cut diamond according to the present invention has a square or rectangular table and a pavilion formed underneath the table, which comprises four triangular lower-girdle facets and four lower-main facets oriented obliquely from each corner of the square or rectangular table to the culet of the gemstone, the upper opposite sides of each lower-main facet adjoining the adjacent triangular lower-girdle facets whereas the lower opposite sides of each lower-main facet adjoining the confronting lower opposite sides of the adjacent lower-main facets.

Each side of the square table is 2 unit lengths long, and the pavilion is 1.8 unit lengths high.

The diamond is an enneahedron having one table, four lower-girdle facets and four lower-main facets.

A diamond assembly according to the present invention comprises a plurality of enneahedral-cut diamonds arranged side by side and combined with their square or rectangular tables facing each other or with their square or rectangular tables directed outwards.

According to the diamond cutting method of the present invention, the resulting diamond is enneahedral-cut one, which the number of facets is very few and accordingly the cutting work is relatively easy. Also, though the structure of the pavilion is simple as a whole, neat and elegant, characteristic fire pattern appears on the table, which is not seen in the conventional diamonds.

Also, advantageously two pieces of raw material are available by cutting and dividing a single gemstone (regular octahedron) into two pieces of same size, and thus, the enneahedral-cut diamonds of the invention can be produced at a decreased cost.

Other objects and advantages of the present invention will be understood from the following description of diamond cuts or diamond cut assemblies according to some preferred embodiments of the present invention, which are shown in accompanying drawings.

DETAILED DESCRIPTION OF PREFERRED EMBODIMENT

Figure 1:
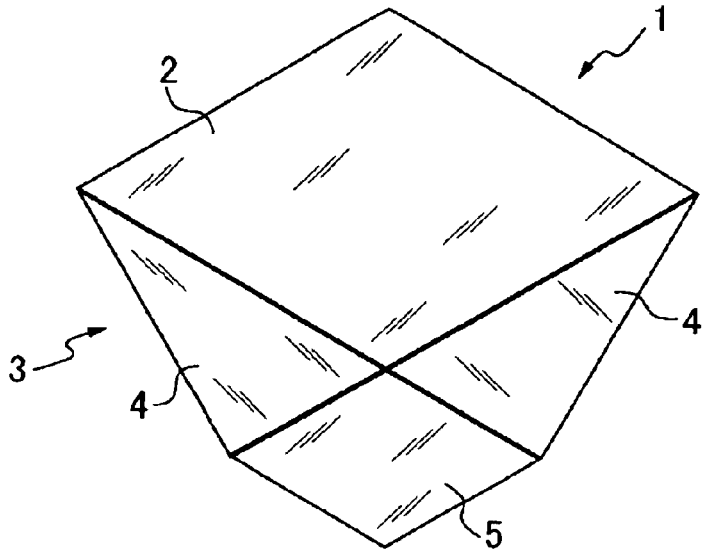
FIG. 1 is a perspective view of an enneahedral-cut diamond according to the present invention as viewed from the top of the diamond.
Figure 2:
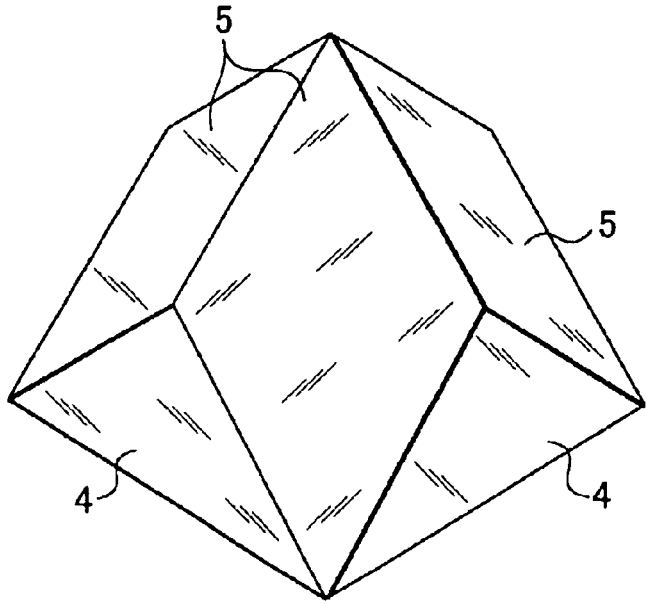
FIG. 2 is a perspective view of the diamond as viewed from the bottom of the diamond.

Referring to FIGS. 1 to 7, an enneahedral-cut diamond 1 according to the present invention comprises a table 2 and a pavilion 3 integrally connected to the table 2, and such a crown-less diamond 1 is distinguishable from the ordinary diamond comprising an integral combination of table, crown and pavilion.

The table 2 may be square or rectangular. As seen from these drawings, the enneahedral-cut diamond 1 can be provided by cutting vertically from each side of the square or rectangular table 2 to define the lower-girdle facet sections 4 and by cutting obliquely from each corner of the square or rectangular table 2 to the culet of the pavilion to define the lower-main facet sections 5. Thus, the pavilion 3 is virtually made up with eight facets 4 and 5.

The enneahedral-cut diamond 1 is a table-and-pavilion enneahedron, simple in structure. Advantageously two pieces of raw material are available by cutting and dividing a single gemstone (regular octahedron) into two pieces of same size, and the cutting work is relatively easy. Thus, enneahedral-cut diamonds can be produced at a decreased cost.

As for the facet sizes and cut angles of the enneahedral-cut diamond 1, each side of the square table 1 is 20 mm long (FIG. 3); the diamond is 18 mm high (FIG. 4); and each lower-girdle facet 4 is 9 mm high. The lower-girdle facet 4 is an isosceles triangle.

Figure 5:
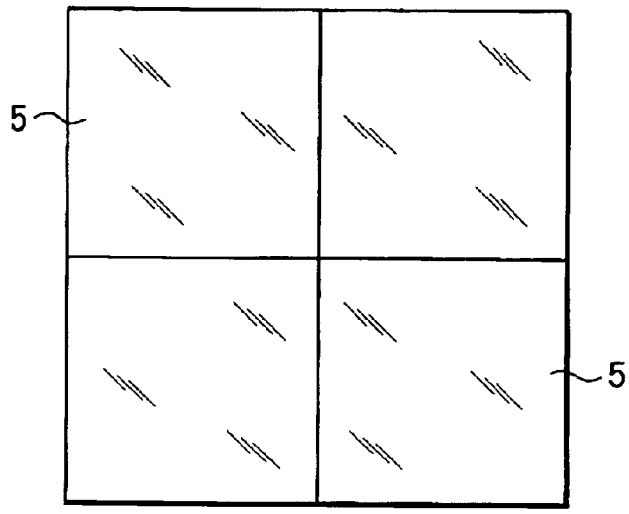
FIG. 5 is a bottom view of the diamond.

When the enneahedral-cut diamond 1 is viewed from the bottom side, the four lower-main facets 5 look like a square having crossing lines to divide the bottom into four divisional squares (see FIG. 5).

Figure 6:
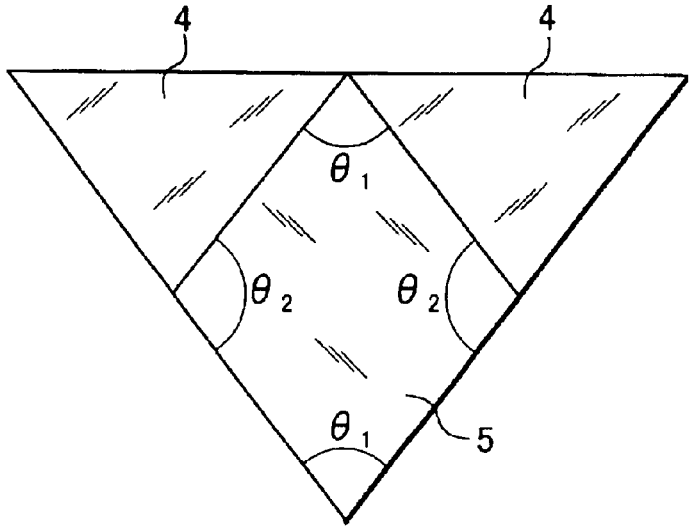
FIG. 6 is a side view of the diamond as viewed in the direction indicated by arrow 6 in FIG. 3.

Each lower-main fact 5 is rhomboidal, the upper or lower angle $\theta_1$ is 60 degrees whereas the laterally opposite angle $\theta_2$ is 120 degrees (see FIG. 6).

Figure 7:
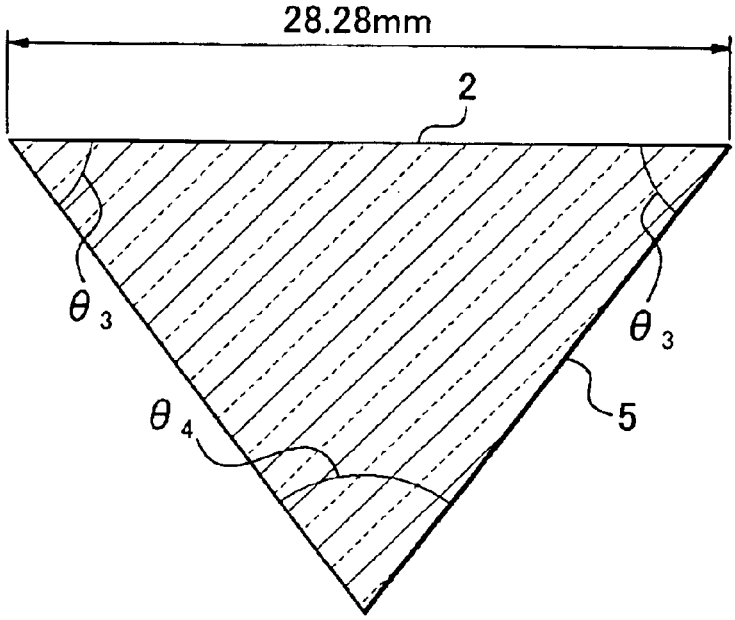
FIG. 7 is a sectional view of the diamond taken along the line 7—7 in FIG. 3.

Referring to FIG. 7, the angle $\theta_3$ formed between the square table 2 and each lower-main facet 5 is 51.84 degrees, and the angle $\theta_4$ formed between the opposite converging lower-main facets is 76.32 degrees.

Figure 3:
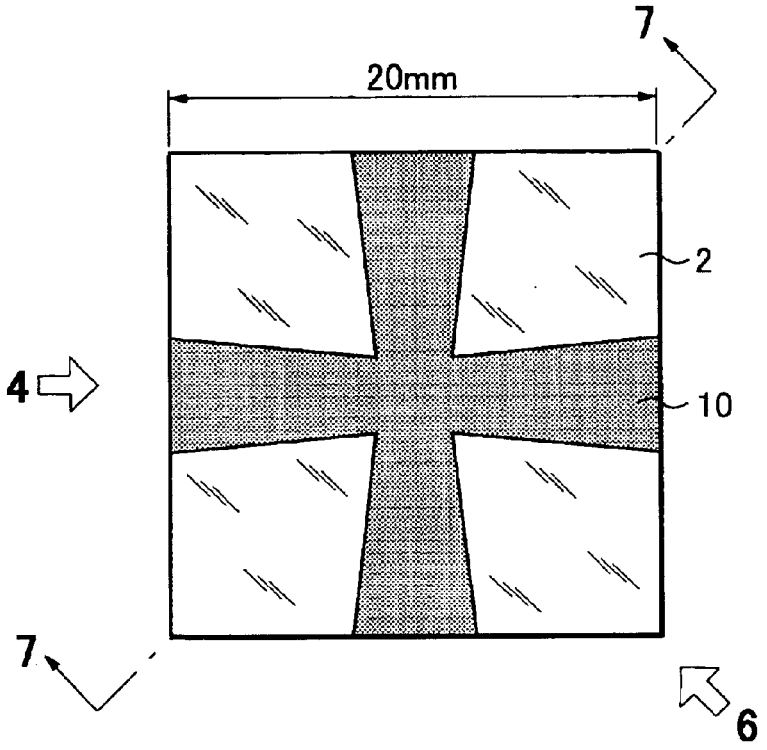
FIG. 3 is a plane view of the diamond.
Figure 4:
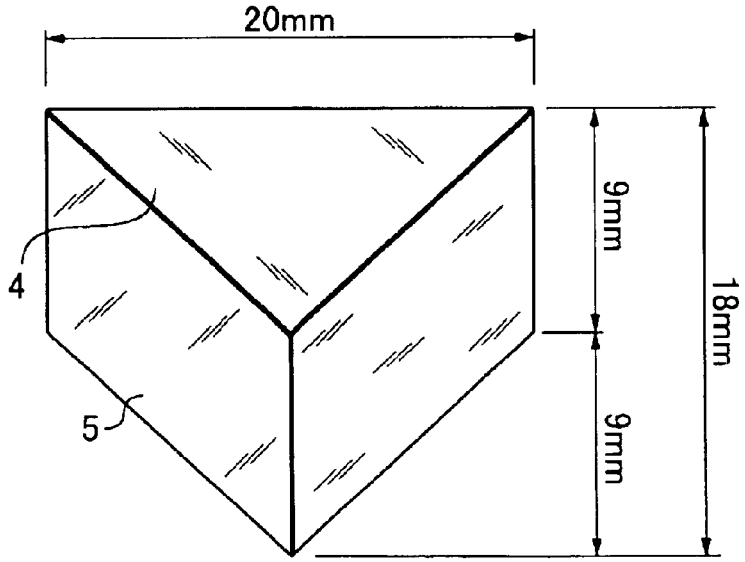
FIG. 4 is a side view of the diamond as viewed in the direction indicated by arrow 4 in FIG. 3.

Referring to FIG. 3, the table-and-pavilion diamond causes a cross fire 10 to appear on the table 2 when viewed from the above.

Figure 8:
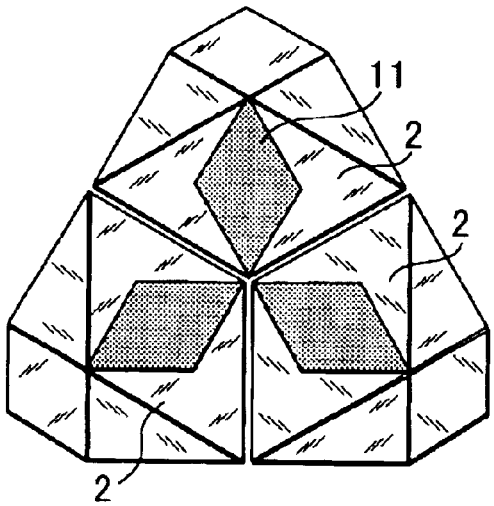
FIG. 8 is a top view of a three-diamond assembly.

An integration of plural enneahedrons provides a large-sized diamond assembly of fantastic shape. As shown in FIG. 8, three enneahedrons are combined with their tables 2 directed inward. A fire 11 in the form of rhombus appears in each of the three tables 2 directed inward in the assembly, so that a three-diamond fire pattern may appear in the hexagonal concave of the diamond assembly.

Figure 9:
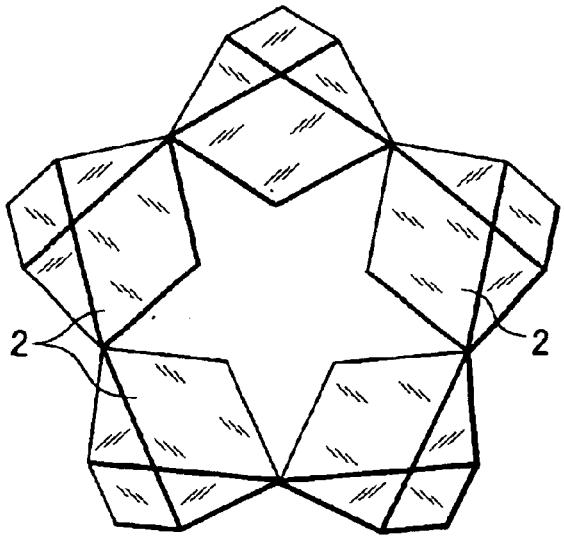
FIG. 9 is a top view of a five-diamond assembly.

As shown in FIG. 9, five enneahedrons are combined to define a five-pointed star-like space inside by directing their tables 2 inward and by abutting the obliquely opposite corners of the tables 2.

Figure 10:
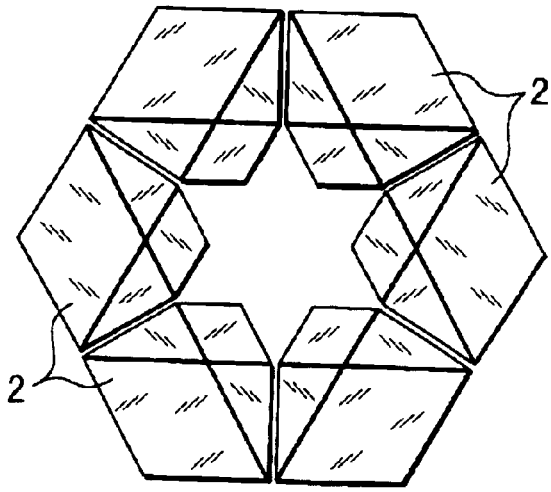
FIG. 10 is a top view of a six-diamond assembly.

As shown in FIG. 10, six enneahedrons are combined to define a six-pointed star-like space inside by directing their tables 2 outward and by abutting the confronting lower-main facets 5 of adjacent diamonds.

All of these diamond assemblies can be provided by arranging a number of enneahedrons radially with one selected lower-main facet 5 each of the diamonds laid on one and same plane, thereby setting the assembled diamonds in stable condition.

As may be understood from the above, the surprisingly simple cut according to the present invention permits simple-shaped diamonds to be combined in variety, thereby providing large-sized, fantastic cuts as anyone ever could see. The cutting method can be equally applied to gemstones other than diamond, such as crystal or semi-precious stone.

What is claimed is:

1. An enneahedral-cut diamond having a square or rectangular table and a pavilion formed underneath the table, which comprises:

four triangular lower-girdle facets each of which extends from each side of the square or rectangular table perpendicularly to the square or rectangular table; and four lower-main facets each of which extends obliquely from each corner of the square or rectangular table to a culet of the diamond so that upper opposite sides of each lower-main facet adjoin adjacent ones of the triangular lower-girdle facets, whereas the lower opposite sides of each lower-main facet adjoin confronting lower opposite sides of adjacent ones of the lower-main facets.

2. A diamond according to claim 1, wherein the table is square, vand a ratio of a length of each side of the square table to a height of the pavilion is 2 to 1.8.

3. A diamond assembly comprising a plurality of enneahedral-cut diamonds arranged side by side and combined with their square or rectangular tables directed inward or outward relative to the diamond assembly, wherein each of the enneahedral-cut diamonds has a square or rectangular table and a pavilion formed underneath the table, and comprises:

four triangular lower-girdle facets each of which extends from each side of the square or rectangular table perpendicularly to the square or rectangular table; and four lower-main facets each of which extends obliquely from each corner of the square or rectangular table to a culet of the diamond so that upper opposite sides of each lower-main facet adjoin adjacent ones of the triangular lower-girdle facets.

* * * * *